United States Patent [19]

Alkins

[11] 4,077,521

[45] Mar. 7, 1978

[54] TELEPHONE PENCIL HOLDER

[76] Inventor: James G. Alkins, 357 St. Marks Ave., Freeport, N.Y. 11520

[21] Appl. No.: 746,858

[22] Filed: Dec. 2, 1976

[51] Int. Cl.[2] ..... A47F 7/00

[52] U.S. Cl. ..... 211/69.1; 24/81 B; 248/226.5; 248/316 D; 24/259 R

[58] Field of Search ..... 211/69–69.9; 248/226.5, 316 D, 228–231, 300, 301, 214, 215, 58–63, 65, 68 R, 69, 70, 72, 74 R, 74 P, 74 RB; 179/178; 24/10, 11, 73 R, 73 BC, 73 BP, 73 P, 73 HH, 73 PC, 73 PF, 73 PM, 73 PP, 73 SA, 73 SG, 73 SM, 73 SS, 81 R, 81 B, 81 BA, 81 BM, 81 CC, 81 CL, 81 G, 81 PB, 81 SK, 81 TH, 81 PH, 81 TA, 259 R, 259 FS, 259 PF, 259 C, 259 B, 255 AS, 255 PH, 255 C, 255 P

[56] References Cited

U.S. PATENT DOCUMENTS

| | | | |
|---|---|---|---|
| 248,315 | 10/1881 | Hodgden | 248/229 X |
| 793,332 | 6/1905 | Walker | 24/259 PF |
| 1,308,869 | 7/1919 | Rehmer | 248/74 A |
| 1,613,416 | 1/1927 | Smith | 24/81 B |
| 2,564,517 | 8/1951 | Beals | 248/229 X |
| 2,803,050 | 8/1957 | Fernberg | 24/259 C |
| 2,843,684 | 9/1958 | Guardino | 211/69.9 X |
| 2,926,959 | 3/1960 | Lyon | 24/81 B X |
| 3,136,357 | 6/1964 | Lorentzen et al. | 24/259 R X |
| 3,438,604 | 4/1969 | Spicer | 24/81 R |

FOREIGN PATENT DOCUMENTS

| | | | |
|---|---|---|---|
| 825,682 | 12/1951 | Germany | 24/259 PF |
| 269,757 | 7/1950 | Switzerland | 24/259 R |

*Primary Examiner*—Roy D. Frazier
*Assistant Examiner*—Terrell P. Lewis
*Attorney, Agent, or Firm*—Bauer, Amer & King

[57] ABSTRACT

A pencil-gripping device or holder which snaps into position about the handle of a telephone handset so that the pencil, or possibly ball point pen, is conveniently accessible for removal therefrom preparatory to use, but otherwise remains supported lengthwise of the handle in an uninterfering position during use of the telephone.

5 Claims, 4 Drawing Figures

TELEPHONE PENCIL HOLDER

The present invention relates generally to a convenience item for a telephone, and more particularly to a pencil or pen holder, of simple construction, which snap-fits about the telephone handset handle.

To assist in the taking of telephone messages, there are numerous types of combination pencil and pad devices, as well as numerous models of devices or holders that are attachable to the base of the telephone which, in practice, receive a pencil or other writing instrument. While the foregoing usually make taking telephone messages more convenient, they are not entirely satisfactory. Specifically, the pencil and pad combinations inadvertently become detached or dissociated from the telephone and thus are not always available to use. The referred to holders, on the other hand, which are, and remain, attached, are permanently secured to the telephone base, and since the pencils or pens of these permanently secured holders are usually of a special shape or construction, when these pencils are lost, there is some inconvenience experienced in obtained replacements. Also, there is an obligation to obtain a replacement since the telephone has permanently attached to it an empty holder of no particular utility.

Broadly, it is an object of the present invention to provide an improved telephone pencil holder overcoming the foregoing and other shortcomings of the prior art. Specifically, it is an object to provide a holder for a conventional pencil or the like which, although having a comparatively secure operative position in relation to the telephone, is readily removable, as well as mountable thereon, thus providing an option regarding its use.

A pencil or pen holder demonstrating objects and advantages of the present invention is comprised, in a preferred embodiment, of a flexible plastic, and is adapted to snap about the handle of the telephone handset. To this end, the holder includes a body having walls cooperating to define a U-shaped handle-receiving compartment. One of these walls additionally, has an inwardly turned lip which extends into the handle-receiving compartment to partition off a pencil-gripping compartment. In use, the flexuring of the lip simultaneously sizes both the handle-receiving and pencil-gripping compartments so that frictional engagement or gripping is established for the handle with respect to the former compartment and also for a pencil projected into the latter compartment.

The above brief description, as well as further objects, features and advantages of the present invention, will be more fully appreciated by reference to the following detailed description of a presently preferred, but nonetheless illustrative embodiment in accordance with the present invention when taken in conjunction with the accompanying drawings, wherein.

Figure 1:
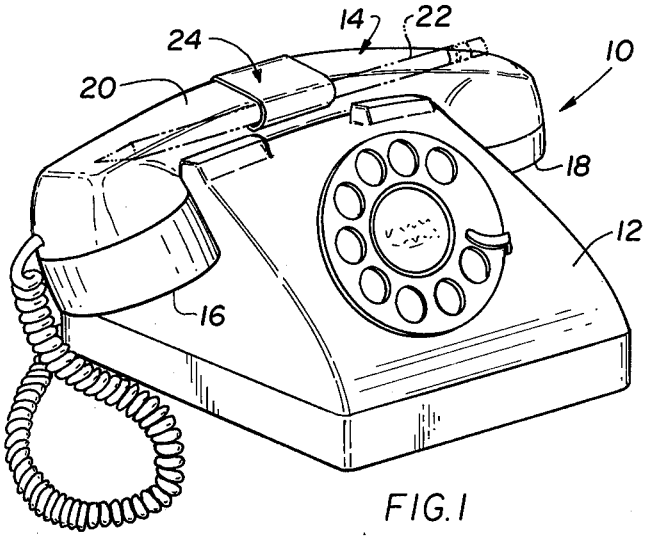
FIG. 1 is a perspective view of a telephone including a handset and supporting cradle, on the handset of which there is mounted a pencil holder which demonstrates objects and advantages of the present invention.

Illustrated in FIG. 1 is a typical telephone 10 having a base 12 which serves as a cradle support for a handset, generally designated 14 which, as generally understood, includes a transmitter 16 and a receiver 18 embodied in a unitary interconnecting handle 20. Underlying the present invention is the recognition that during use of the telephone 10 it is often necessary to take messages and, to this end, it is therefore desirable to have a writing instrument readily accessible, such instrument being a conventional cylindrically shaped pencil 22, or possibly a similarly shaped ball point pen. As used throughout the description and in the appended claims reference to a pencil per se is therefore not intended as a restriction on the scope of the invention. In accordance with the present invention, pencil 22 is rendered accessible to the user of the telephone 10 in that it is supported along the side of the handle 20, as illustrated, within the inventive holder 24 hereof, now to be described in detail.

Figure 3:
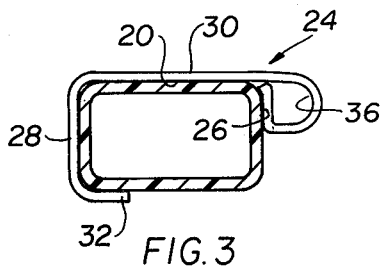
FIG. 3 is a side elevational view, in section, showing additional structural features.
Figure 2:
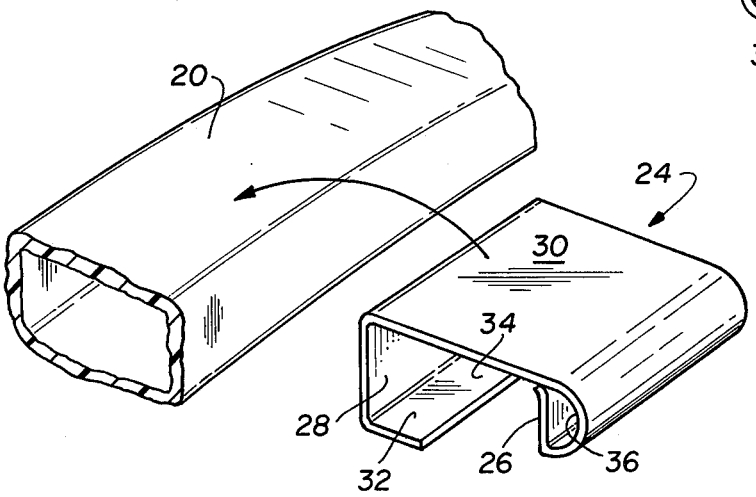
FIG. 2 is a partial perspective view showing further structural details of the holder.
Figure 4:
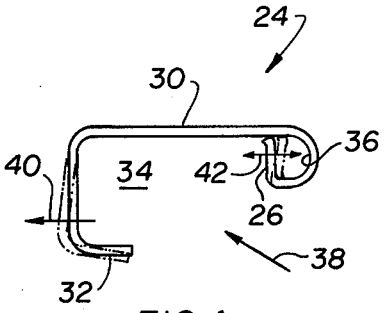
FIG. 4 is an additional side elevational view of the holder in which positions of flexuring movement of the walls thereof are illustrated in full line and phantom line perspective.

As is perhaps best illustrated in FIGS. 2–4, holder 24 is of simple construction and will be understood to be comprised of a flexible construction material, such as metal, plastic or the like. In use, holder 24 has a snap frictional fit on the handle 20, said fit being attributable mainly to the bias or urgency of the flexible material of construction which results in opposing or facing wall 26 and 28 pressing against the sides of the handle 20 that is moved into an interposed position therebetween. As is perhaps best illustrated in FIGS. 2–4, to which reference should be made in conjunction with FIG. 1, it will be noted that the handle-gripping wall 26 is, in the preferred embodiment illustrated, an inwardly extending lip or extension of wall 30 which interconnects the walls 28, 26. Extending from the opposite side of the handle-gripping wall 28, substantially parallel to the interconnecting wall 30, is an additional wall 32 which helps secure the operative position of the holder 24 on the handle 20 by extending beneath the lower surface of the handle.

At this point in the description it should be noted that the referred to handle-gripping walls 26 and 28, and the interconnecting wall 30 therebetween, cooperate to define a generally U-shaped compartment, designated 34 in FIG. 2, which in practice, is sized relative to the size of the handle 20 to provide a snap-fit or friction fit thereon. In an advantageously noteworthy manner, extension or lip 26 which extends from the wall 30 into the compartment 34 serves to partition off the pencil-gripping compartment 36 which is oriented transversely of the holder 24 and thus lengthwise the handset handle 20. In use, of course, pencil 22 is projected through the compartment 36 in order to establish the supported position for the pencil 22 as illustrated in FIG. 1.

As perhaps may best be understood from FIG. 4, the flexible material of construction of the opposing walls 28 and 26 allow these walls to partake of flexuring movements 40 and 42, respectively, which flexuring movements occur when the handset handle 20 is projected as in the direction 38 through the opening into the compartment 34. In this connection, it is significant that the wall or lip 26 is adapted to flex in opposite directions 42, all as is illustrated, since these flexuring movements enable this wall to affect both the size of the compartment 34 and also that of the compartment 36. Thus, assuming that the holder 24 is in its position on the handle 20, initially lip 26, due to the size of the handle 20, may be urged from its full line into its phantom line position which produces a pencil-gripping compartment 36 of a reduced size. Thereafter, when the pencil 22 is projected into the compartment 36, this will have a tendency of causing expansion in the compartment 36 to accommodate the pencil which, of course, will result in the urging of the lip 26 through a flexuring movement 42 from its phantom line to its full line position. This is allowed for by movement of the wall 28 through a corresponding slight pivotal traverse or flexure movement 40. In this manner, frictional engagement is established both for the handle 20 within the compartment 34 and also for the pencil 22 within the compartment 36.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. A holder for a pencil or the like having an operative supported position on a handle of a telephone handset, said holder comprising a body fabricated of flexible construction material having at one end thereof a cooperating pair of handle-engaging walls in opposing face relation to each other for engagement with opposed walls of a handle of a telephone handset, a wall on said body interconnecting said opposed handle-engaging walls in spaced relation to a telephone handset handle, and an encircling wall configuration at the other end of said body formed by said body bounding a generally cylindrically shaped compartment oriented longitudinally of a telephone handset handle as a contiguous extension of one end of one of said opposed walls with said encircling wall defining an opening to frictionally grip a pencil or the like projected therethrough, whereby a gripped pencil is conveniently held to a handset and is accessible for removal preparatory to use but otherwise remains supported in an uninterfering position on the side of a telephone handset handle during use thereof and a snap-fit of said walls is provided incident to the positioning of a telephone handset handle in an interposed position between said walls.

2. A pencil holder attachment for a telephone handset handle as claimed in claim 1 wherein said pair of facing handle-engaging walls and said interconnecting wall cooperate to bound a U-shaped handle-receiving compartment, said handle-engaging walls being adapted to flex toward and away from each other to vary the size of said compartment for frictional engagement with a telephone handset handle positioned therebetween.

3. A pencil holder attachment for a telephone handset handle as claimed in claim 2 wherein said one flexing handle-engaging wall is contiguous with said pencil-gripping encircling wall configuration, whereby the flexing movement of said wall also contributes to varying the size of said cylindrically-shaped compartment for frictional engagement with a pencil projected therethrough.

4. A pencil holder of flexible construction material adapted to be supported at a medial location on a handle of a telephone handset comprising a body having walls cooperating to define a U-shaped handle-receiving compartment, and one said wall having a contiguously extending inwardly turned lip extending in a clearance position into said compartment to partition off a pencil-gripping compartment as a contiguous extension of and at the end of said handle-receiving compartment, whereby flexuring of said lip simultaneously varies the size of both said handle-receiving and said pencil-gripping compartments to contribute to establishing frictional engagement thereof respectively with a telephone handset handle in said handle-receiving compartment and a pencil in said pencil-receiving compartment.

5. A pencil holder attachable to a telephone handset handle as claimed in claim 4 wherein said pencil-gripping compartment is adapted to be oriented lengthwise of a telephone handset handle in the operative position of said holder on a telephone handset handle, whereby a gripped pencil is conveniently accessible for removal preparatory to use but otherwise remains supported in an uninterfering position on a telephone handset handle during use of the same.

* * * * *

UNITED STATES PATENT OFFICE

CERTIFICATE OF CORRECTION

PATENT NO. : 4,077,521

DATED : March 7, 1978

INVENTOR(S) : James G. Alkins

It is certified that error appears in the above-identified patent and that said Letters Patent are hereby corrected as shown below:

Claim 1, line 5, change "face" to --facing--

Signed and Sealed this

*First* Day of *August 1978*

[SEAL]

*Attest:*

RUTH C. MASON
*Attesting Officer*

DONALD W. BANNER
*Commissioner of Patents and Trademarks*